US009356433B2

(12) United States Patent
Lewandowski et al.

(10) Patent No.: US 9,356,433 B2
(45) Date of Patent: May 31, 2016

(54) IGNITION COIL CAPTURED RESISTOR

(75) Inventors: Gregory Lewandowski, Plymouth, MI (US); Greg Westrick, Ferndale, MI (US); Jeongung Hwang, Northville, MI (US)

(73) Assignee: DENSO International America, Inc., Southfield, MI (US)

( * ) Notice: Subject to any disclaimer, the term of this patent is extended or adjusted under 35 U.S.C. 154(b) by 1035 days.

(21) Appl. No.: 13/468,251

(22) Filed: May 10, 2012

(65) Prior Publication Data

US 2013/0298887 A1 Nov. 14, 2013

(51) Int. Cl.
*H01F 38/12* (2006.01)
*H01T 13/05* (2006.01)

(52) U.S. Cl.
CPC ..... *H01T 13/05* (2013.01)

(58) Field of Classification Search
CPC ..... H01T 13/05; F02P 15/00
USPC ..... 439/789, 824, 828; 123/647
See application file for complete search history.

(56) References Cited

U.S. PATENT DOCUMENTS 2,200,993 A * 5/1940 Marshall ..... H01R 13/20 439/381
3,803,529 A * 4/1974 Rohrig ..... H01R 24/20 139/125
4,085,434 A * 4/1978 Stevens ..... G08G 1/081 361/785
5,148,086 A * 9/1992 Costa ..... H01R 4/2416 174/DIG. 2
5,170,767 A 12/1992 Wada et al.
5,603,306 A * 2/1997 Tai ..... H01B 7/0063 123/169 PH
6,724,289 B2 * 4/2004 Moga ..... H01F 27/362 123/634
6,793,863 B1 * 9/2004 Himes, II ..... B29C 45/14491 264/262
6,926,266 B1 8/2005 Paul et al.
7,036,495 B1 * 5/2006 Shimizu ..... H01T 13/44 123/260
2002/0014939 A1 * 2/2002 Martagni ..... H01T 13/05 336/90
2006/0089024 A1 * 4/2006 Kraus ..... H01T 13/05 439/125
2009/0301450 A1 12/2009 Lindenthal et al.

FOREIGN PATENT DOCUMENTS

JP 2006-049475 2/2006
JP 2006-324515 11/2006
JP 2007-187104 7/2007
JP 2009-535828 10/2009
JP 2010-258247 11/2010
JP 2011-190767 9/2011

OTHER PUBLICATIONS

Office Action issued Sep. 22, 2014 in corresponding KR Application No. 10-2013-0031806 (with English translation).
Office Action issued Mar. 9, 2015 in corresponding KR Application No. 10-2013-0031806 (with English translation).
Office Action issued Apr. 1, 2014 in corresponding JP Application No. 2012-270645 (with English translation).
Office Action mailed Nov. 2, 2015 in the corresponding KR Application No. 10-2013-0031806.

* cited by examiner

*Primary Examiner* — Hieu T Vo
*Assistant Examiner* — Arnold Castro
(74) *Attorney, Agent, or Firm* — Harness, Dickey & Pierce, P.L.C.

(57) ABSTRACT

A motor vehicle ignition assembly. The assembly includes a high voltage tower, a retention clip coupled to the high voltage tower, and a resistor mounted within the retention clip.

20 Claims, 3 Drawing Sheets

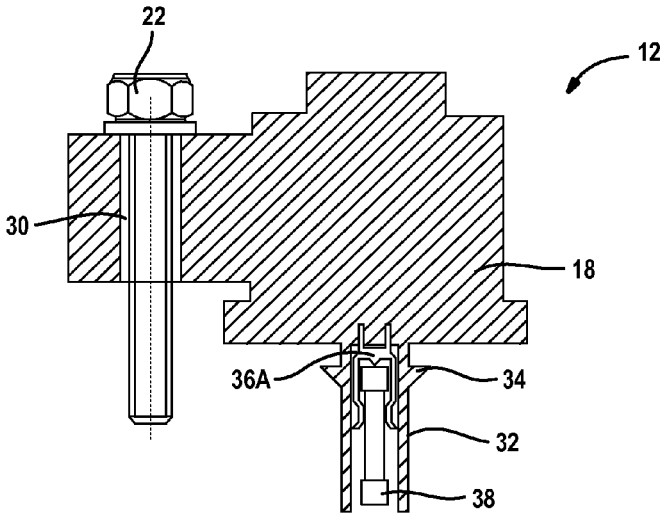
FIG. 3
FIG. 4A
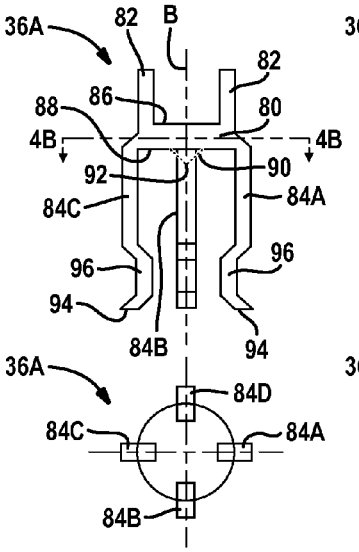
FIG. 4B
FIG. 5A
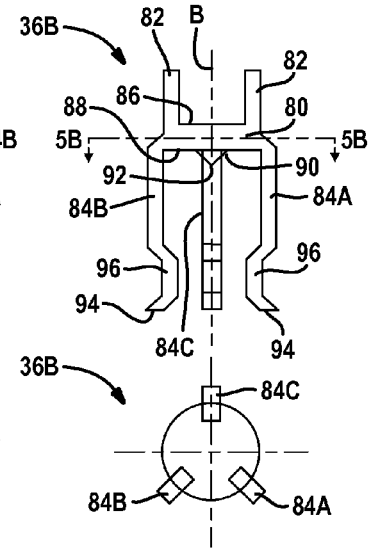
FIG. 5B
FIG. 6A
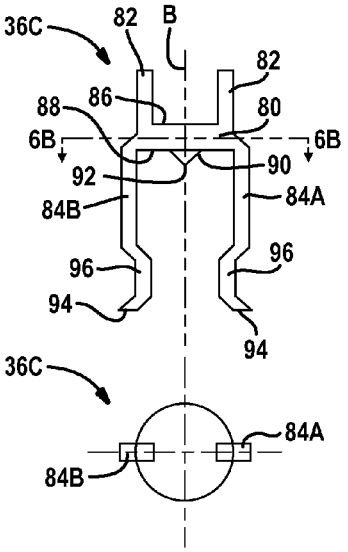
FIG. 6B

IGNITION COIL CAPTURED RESISTOR

FIELD

The present disclosure relates to ignition coil resistors.

BACKGROUND

This section provides background information related to the present disclosure which is not necessarily prior art.

Ignition assemblies for internal combustion engines often include a high voltage tower with an ignition coil boot attached thereto. A first end of the boot is connected to the high voltage tower, and a second end of the boot is connected to a spark plug. A resistor is arranged between the high voltage tower and an ignition coil of the boot. The resistor is not affixed to either the high voltage tower or the boot. As a result, if the boot is removed, such as for service or replacement, the resistor will undesirably become detached from the high voltage tower. The resistor must thus be separately handled to prevent it from undesirably dropping to the floor, for example.

SUMMARY

This section provides a general summary of the disclosure, and is not a comprehensive disclosure of its full scope or all of its features.

The present teachings provide for a motor vehicle ignition assembly. The assembly includes a high voltage tower, a retention clip mounted within the high voltage tower, and a resistor coupled to the retention clip.

The present teachings also provide for a motor vehicle ignition assembly including a high voltage tower, a retention member arranged within the high voltage tower, a resistor secured within the high voltage tower with the retention member, and an ignition boot. The ignition boot includes a first end and a second end opposite to the first end. The first end is removably coupled to the high voltage tower. The second end defines an opening configured to receive a spark plug. Upon decoupling the ignition boot from the high voltage tower, the resistor remains secured within the high voltage tower with the retention member.

The preset teachings further provide for a motor vehicle ignition assembly including a high voltage tower, a retention clip mounted within the high voltage tower, a resistor connected to the retention clip, an ignition boot, and an ignition coil. The ignition boot is removably coupled with the high voltage tower and defines a bore. The ignition coil is mounted within the bore of the boot, and includes a first end connected to the resistor and a second end configured to couple with a spark plug.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 3 is cross-sectional view of a coil body of the ignition assembly of FIG. 1;

FIG. 4A is a side view of a retention clip according to the present teachings;

FIG. 4B is a cross-sectional view taken along line 4B-4B of FIG. 4A;

FIG. 5A is a side view of another retention clip according to the present teachings;

FIG. 5B is a cross-sectional view taken along line 5B-5B of FIG. 5A;

FIG. 6A is a side view of an additional retention clip according to the present teachings;

FIG. 6B is a cross-sectional view taken along line 6B-6B of FIG. 6A.

Corresponding reference numerals indicate corresponding parts throughout the several views of the drawings.

DETAILED DESCRIPTION

Example embodiments will now be described more fully with reference to the accompanying drawings.

Figure 1:
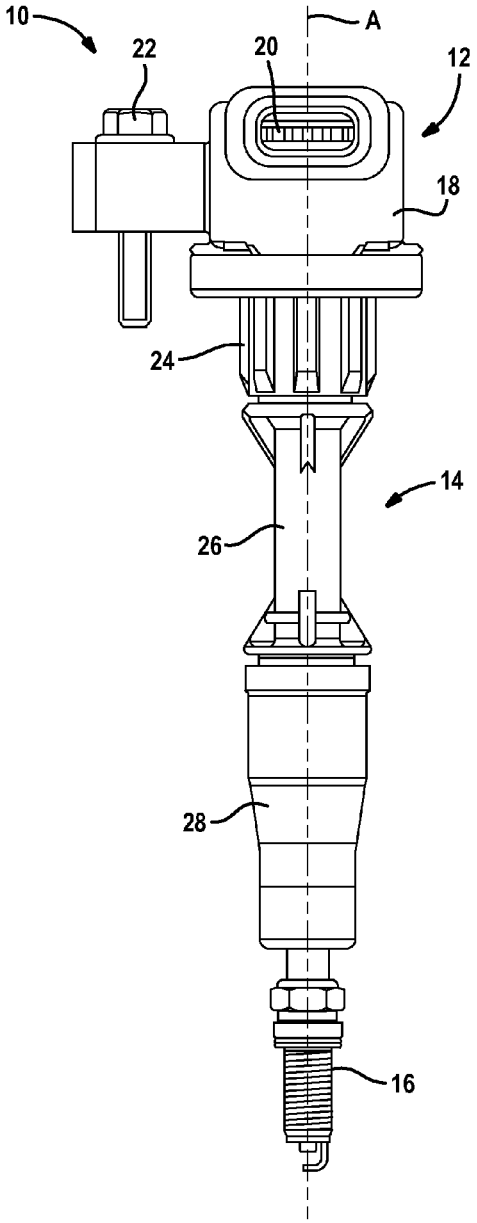
FIG. 1 is a side view of an ignition assembly according to the present teachings.

With initial reference to FIG. 1, an ignition assembly according to the present teachings is generally illustrated at reference numeral 10. The ignition assembly 10 generally includes a coil body 12, an ignition boot 14 removably mounted to the coil body 12, and a spark plug 16. The ignition assembly 10 can be any suitable ignition assembly for nearly any internal combustion engine, such as a motor vehicle engine for example.

The coil body 12 generally includes a case 18, an electrical connector 20, and a fastener 22. The connector 20 extends from the case and is configured to connect with any suitable current source. The fastener 22 extends through the case 18 to secure the ignition assembly 10 at any desired location. For example, the fastener 22 can secure the ignition assembly 10 to, or proximate to, an internal combustion engine.

The ignition boot 14 generally includes a plug hole seal 24, a pole joint 26, and a cap plug 28. The plug hole seal 24 is removably connected to the case 18 of the coil body 12. The pole joint 26 is coupled to the plug hole seal 24, and the cap plug 28 is connected to the pole joint 26. The plug hole seal 24, the pole joint 26, and the cap plug 28 are aligned along a longitudinal axis A of the ignition boot 14. The spark plug 16 is received within the cap plug 28.

Figure 2:
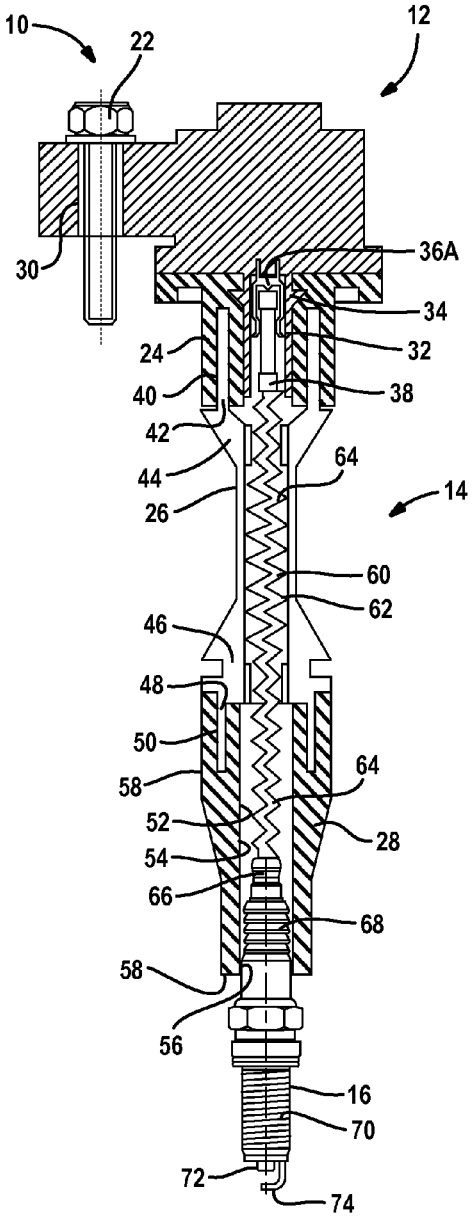
FIG. 2 is a cross-sectional view of the ignition assembly of FIG. 1.

With continued reference to FIG. 1 and additional reference to FIG. 2, additional features of the ignition assembly 10 will now be described. With respect to the case 18 of the coil body 12, the case 18 includes a bushing 30 extending therethrough, which receives the fastener 22. The case 18 further includes a high voltage tower 32 extending from the case 18. The high voltage tower 32 is generally annular. Protruding outward from the high voltage tower 32 is a retention tab 34. The retention tab 34 can be an annular tab that extends continuously around the high voltage tower 32, or the retention tab 34 can include a plurality of tabs 34 spaced apart from one another. The retention tab 34 releasably cooperates with the seal 24 to removably couple the seal 24 to the case 18.

A retention clip 36A is mounted to the coil body 12 within the high voltage tower 32, and a resistor 38 is releasably coupled to the retention clip 36A. The retention clip 36A retains the resistor 38 in cooperation with the coil body 12 when the boot 14 is separated from the coil body 12. Therefore, the boot 14 can be separated from the coil body 12 for replacement or repair without the resistor 38 becoming disconnected from the coil body 12 and, for example, falling to the ground. The retention clip 36A is electrically coupled to the connector 20 in any suitable manner, such as with one or more conductors (not shown). Additional details the retention clip 36A are set forth herein, such as in conjunction with the description of FIGS. 4A-6B.

The seal 24 defines a receptacle 40. The receptacle 40 is sized and shaped to receive a flange 42 extending from a first end 44 of the pole joint 26. The flange 42 can be retained within the receptacle 40 in any suitable manner, such as with an adhesive or mechanical connection, to connect the pole joint 26 to the seal 24. Extending from a second end 46 of the pole joint 26 is an additional flange 48. The flange 48 and a receptacle 50 of the cap plug 28 are sized and shaped to cooperate with one another to secure the pole joint 26 to the cap plug 28. The flange 48 can be retained within the receptacle 50 in any suitable manner, such as with a suitable adhesive or mechanical connection.

The boot 14 defines a bore 52 that extends through the boot 14 along the longitudinal axis A. The bore 52 includes an inner surface 54 that extends completely through each of the seal 24, the pole joint 26, and the cap plug 28. At the seal 24, the bore 52 receives therein the high voltage tower 32 and the retention clip 36A with the resistor 38 mounted thereto. The bore 52 provides a passageway through the boot 14 from the high voltage tower 32 to an orifice 56 of the cap plug 28 at a distal end 58 of the boot 14.

Secured within the bore 52 is an ignition coil 60. The ignition coil 60 includes a first diameter portion 62 and a second diameter portion 64. The first diameter portion 62 has a greater diameter than the second diameter portion 64. The second diameter portion 64 is provided on both sides of the first diameter portion 62. The first diameter portion 62 has a diameter that is slightly larger than an inner diameter of the bore 52 at the pole joint 26. Therefore, friction between the first diameter portion 62 and the inner surface 54 of the bore 52 retains the ignition coil 60 within the boot 14. The ignition coil 60 is arranged within the boot 14 such that it is in electrical contact with the resistor 38 at one end and in electrical contact with the spark plug 16 at an opposite end.

The spark plug 16 generally includes a terminal 66, ribs 68, external threads 70, a central electrode 72, and a lateral electrode 74. The spark plug 16 extends through the orifice 56 and into the bore 52. The spark plug 16 is arranged such that the terminal 66 and the ribs 68 are seated within the bore 52 and the external threads 70 are connected to, for example, a cylinder head of a motor vehicle engine. The ignition coil 60 is in electrical contact with the terminal 66 to conduct current between the resistor 38 and the terminal 66.

With additional reference to FIG. 3, the coil body 12 is illustrated without the boot 14 connected thereto. The retention clip 36A retains the resistor 38 within the high voltage tower 32 even when the boot 14 is removed. Without the retention clip 36A, upon removal of the boot 14 there would be nothing to retain the resistor 38 within the high voltage tower 32, and thus the resistor 38 would be free to fall out from within the high voltage tower 32.

With reference to FIGS. 4A and 4B, additional details of the retention clip 36A will be described. The retention clip 36A generally includes a base 80, legs 82, and fingers 84. The base 80 includes a first surface 86 and a second surface 88 that is opposite to the first surface 86. The base 80 can be made of any suitable electrically conductive material, such as copper or any other suitable metal.

The legs 82 extend from first surface 86 of the base 80. Two legs 82 are illustrated, but the retention clip 36A can include any suitable number of legs 82. The legs 82 are illustrated as extending generally perpendicular to the base 80, but may be arranged in any other suitable manner as well. The legs 82 are secured within the coil body 12 and are in electrical contact with components of the coil body 12.

At a center of the second surface 88 of the base 80 is a base conductor 90. The base conductor 90 extends from the base 80 and is illustrated as having a pointed tip 92. The base conductor 90 conducts current between the retention clip 36A and the resistor 38 coupled thereto. The base conductor 90 can thus have any suitable shape or size to conduct current between the retention clip 36A and the resistor 38.

The fingers 84 extend from the second surface 88 of the base 80. As illustrated, the retention clip 36A includes four fingers 84A-84D (FIG. 4B) spaced evenly apart about the base at 90° intervals. Each finger 84 includes a distal end 94 that is opposite to the base 80. Proximate to the distal end 94 of each finger 84A-84D is a tapered portion 96. Each of the tapered portions 96 extend, or taper, inward toward a longitudinal axis B of the retention clip 36A.

Although the retention clip 36A includes four fingers 84A-84D, any suitable number of fingers 84 can be provided, and the fingers 84 can be spaced apart at any suitable interval. For example and with reference to FIGS. 5A and 5B, a retention clip 36B is illustrated including three fingers 84A, 84B, and 84C evenly spaced apart about the base 80 at approximately 120° intervals. Another retention clip is illustrated in FIGS. 6A and 6B at reference numeral 36C. The retention clip 36C includes two fingers 84A and 84B spaced apart at 180° intervals. Other than the number and spacing of the fingers 84, the retention clips 36B and 36C are substantially similar to the retention clip 36A, and thus the similar features are designated with the same reference numbers.

Figure 7A:
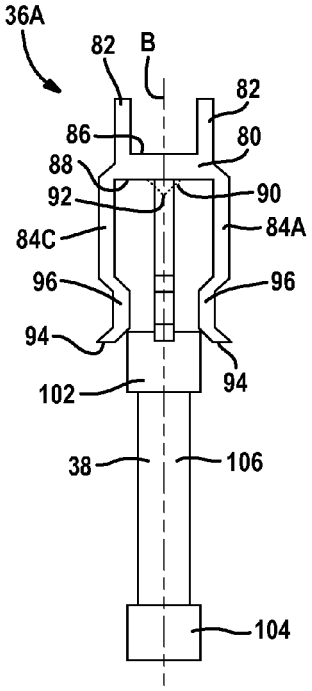
FIGS. 7A-7C illustrate coupling a resistor with the retention clip of FIGS. 4A and 4B.
Figure 7B:
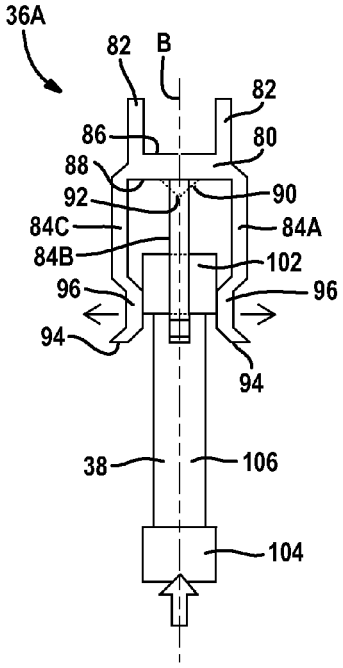
Figure 7C:
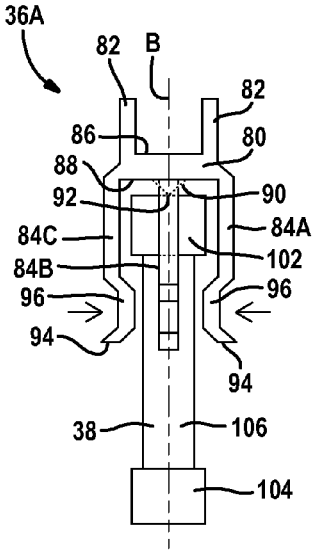

With additional reference to FIGS. 7A-7C, coupling of the retention clip 36A with the resistor 38 is illustrated. The resistor 38 generally includes a first conductor 102 and a second conductor 104 at opposite ends thereof. Between the first conductor 102 and the second conductor 104 is a body portion 106, which has an outer diameter that is smaller than outer diameters of each of the first and the second conductors 102 and 104. The resistor 38 is coupled to the retention clip 36A by aligning the resistor 38 along the longitudinal axis B and pushing the first conductor 102 beyond the tapered portions 96 toward the base 80. As the first conductor 102 contacts the tapered portions 96 of the fingers 84A-84D, the fingers 84A-84D expand outward from the longitudinal axis A to allow the first conductor 102 to pass beyond the tapered portions 96 and be moved toward the base 80. The resistor 38 is pushed along the longitudinal axis A until the first conductor 102 contacts the pointed tip 92 of the base conductor 90. After the first conductor 102 passes beyond the tapered portions 96, the fingers 84A-84D are biased to move back toward the longitudinal axis B to their original position and contact, or closely abut, the body portion 106. With particular reference to FIG. 7C, because the outer diameter of the first conductor 102 is greater than the distance between the fingers 84A-84D at the tapered portions 96, the fingers 84A-84D prevent the first conductor 102 from passing beyond the tapered portions 96, and thus prevent the resistor 38 from becoming decoupled with the retention clip 36, even when the boot 14 is disconnected from the coil body 12.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A motor vehicle ignition assembly comprising:

a high voltage tower;

a retention clip mounted within the high voltage tower, the retention clip includes:

a base;

flexible fingers extending from the base and movable outward from an original position to an expanded position, the flexible fingers are biased to move back towards the original position from the expanded position; and a pointed tip extending from a center of the base;

a resistor coupled to the retention clip, the resistor includes a first conductor, a second conductor, and a body portion therebetween;

wherein:

the resistor is coupled to the retention clip by pushing the first conductor beyond the tapered portions towards the base until the first conductor contacts the pointed tip; and in the original position the flexible fingers closely abut the body portion of the resistor.

2. The motor vehicle ignition assembly of claim 1, wherein the high voltage tower is annular and is coupled to a coil body, and the retention clip is positioned within the annular high voltage tower.

3. The motor vehicle ignition assembly of claim 2, wherein the annular high voltage tower includes at least one retention tab configured to connect an ignition boot to the high voltage tower.

4. The motor vehicle ignition assembly of claim 1, wherein the retention clip comprises:

the base including a first side and a second side opposite to the first side;

a pair of legs extending from the first side, the legs configured to be received by a coil body to couple the retention clip to the coil body; and the flexible fingers include at least two fingers extending from the second side of the base that are spaced apart and configured to receive the resistor therebetween and couple the resistor to the retention clip.

5. The motor vehicle ignition assembly of claim 4, wherein the flexible fingers each include a tapered portion proximate to a distal end, the tapered portions extend inward towards one another and towards a longitudinal axis of the retention clip.

6. The motor vehicle ignition assembly of claim 1, wherein the retention clip includes only four flexible fingers configured to couple the resistor to the retention clip.

7. The motor vehicle ignition assembly of claim 1, wherein:

the body portion of the resistor has an outer diameter that is smaller than an outer diameter of each of the first conductor and the second conductor;

each one of the flexible fingers includes a tapered portion proximate to a distal end thereof that extends inward towards a longitudinal axis of the retention clip;

the outer diameters of the first conductor and the second conductor are each greater than a distance between the flexible fingers at the tapered portions.

8. The motor vehicle ignition assembly of claim 7, wherein the retention clip is configured to securely couple with the resistor when the first conductor of the resistor is pushed beyond the tapered portions of the flexible fingers;

wherein the retention clip is configured such that as the first conductor contacts and is pushed beyond the tapered portions, the flexible fingers expand outward from the longitudinal axis to allow the first conductor to pass beyond the tapered portions; and wherein the retention clip is further configured such that as the body portion contacts the tapered portions the flexible fingers move back towards the original position.

9. The motor vehicle ignition assembly of claim 1, further comprising an ignition boot assembly removably coupled to the high voltage tower, the ignition boot assembly defining a bore with an ignition coil seated therein, the ignition coil including a first end in contact with the resistor and a second end in contact with a spark plug.

10. A motor vehicle ignition assembly comprising:

a high voltage tower;

a retention member arranged within the high voltage tower, the retention member includes:

a base;

flexible fingers extending from the base and movable outward from an original position to an expanded position, the flexible fingers are biased to move back towards the original position from the expanded position; and a pointed tip extending from a center of the base;

a resistor secured within the high voltage tower with the retention member, the resistor includes a first conductor, a second conductor, and a body portion therebetween, wherein in the original position the flexible fingers closely abut the body portion of the resistor; and an ignition boot including a first end and a second end opposite to the first end, the first end removably coupled to the high voltage tower, and the second end defining an opening configured to receive a spark plug;

wherein:

the resistor is coupled to the retention clip by pushing the first conductor beyond the tapered portions towards the base until the first conductor contacts the pointed tip; and upon decoupling the ignition boot from the high voltage tower the resistor remains secured within the high voltage tower with the retention member.

11. The motor vehicle ignition assembly of claim 10, wherein the retention member includes at least one leg coupled to a coil body.

12. The motor vehicle ignition assembly of claim 10, wherein the ignition boot defines a bore, and an ignition coil is seated within the bore.

13. The motor vehicle ignition assembly of claim 10, wherein the retention member is arranged within the high voltage tower.

14. The motor vehicle ignition assembly of claim 10, wherein:

the body portion of the resistor has an outer diameter that is smaller than an outer diameter of each of the first conductor and the second conductor;

each one of the flexible fingers includes a tapered portion proximate to a distal end thereof that extends inward towards a longitudinal axis of the retention clip;

the outer diameters of the first conductor and the second conductor are each greater than a distance between the flexible fingers at the tapered portions.

15. The motor vehicle ignition assembly of claim 14, wherein the retention member is configured to securely couple with the resistor when the first conductor of the resistor is pushed beyond the tapered portions of the flexible fingers;

wherein the retention member is configured such that as the first conductor contacts and is pushed beyond the tapered portions, the flexible fingers expand outward from the longitudinal axis to allow the first conductor to pass beyond the tapered portions; and wherein the retention member is further configured such that as the body portion contacts the tapered portions the flexible fingers move back towards the original position.

16. A motor vehicle ignition assembly comprising:

a high voltage tower;

a retention clip mounted within the high voltage tower, the retention clip includes:

a base;

flexible fingers extending from the base and movable outward from an original position to an expanded position, the flexible fingers are biased to move back towards the original position from the expanded position; and a pointed tip extending from a center of the base;

a resistor connected to the retention clip the resistor includes a first conductor, a second conductor, and a body portion therebetween, wherein in the original position the flexible fingers closely abut the body portion of the resistor;

an ignition boot removably coupled with the high voltage tower, the boot defining a bore; and an ignition coil mounted within the bore of the boot, the ignition coil including a first end connected to the resistor and a second end configured to couple with a spark plug;

wherein the resistor is coupled to the retention clip by pushing the first conductor beyond the tapered portions towards the base until the first conductor contacts the pointed tip.

17. The motor vehicle ignition assembly of claim 16, wherein the retention clip includes a base, at least one leg extending from a first side of the base, the at least one leg is coupled to a coil body.

18. The motor vehicle ignition assembly of claim 16, wherein:

the body portion of the resistor has an outer diameter that is smaller than an outer diameter of each of the first conductor and the second conductor;

each one of the flexible fingers includes a tapered portion proximate to a distal end thereof that extends inward towards a longitudinal axis of the retention clip;

the outer diameters of the first conductor and the second conductor are each greater than a distance between the flexible fingers at the tapered portions.

19. The motor vehicle ignition assembly of claim 18, wherein the retention clip is configured to securely couple with the resistor when the first conductor of the resistor is pushed beyond the tapered portions of the flexible fingers;

wherein the retention clip is configured such that as the first conductor contacts and is pushed beyond the tapered portions, the flexible fingers expand outward from the longitudinal axis to allow the first conductor to pass beyond the tapered portions; and wherein the retention clip is further configured such that as the body portion contacts the tapered portions the flexible fingers move back towards the original position.

20. The motor vehicle ignition assembly of claim 17, wherein each of the fingers include a tapered portion proximate to a distal end of the finger.

* * * * *